US005232761A

United States Patent [19]

Day et al.

[11] Patent Number: 5,232,761

[45] Date of Patent: Aug. 3, 1993

[54] FABRIC

[75] Inventors: Gerald F. Day, Derbyshire; Giles T. Gregory, Nottinghamshire, both of United Kingdom

[73] Assignee: General Motors Corporation, Detroit, Mich.

[21] Appl. No.: 794,242

[22] Filed: Nov. 19, 1991

[30] Foreign Application Priority Data

Nov. 21, 1990 [GB] United Kingdom ..... 9025311

[51] Int. Cl.[5] ..... B32B 3/10; B32B 3/06

[52] U.S. Cl. ..... 428/102; 428/57; 428/193; 112/441

[58] Field of Search ..... 428/57, 102, 192, 193; 112/441

*Primary Examiner*—Alexander S. Thomas

*Attorney, Agent, or Firm*—Davis Hoxie Faithfull & Hapgood

[57] ABSTRACT

Improved three-dimensional structures incorporating two components sewn together, at least one of which is a knitted component, have sewing alignment guides provided at spaced locations along an edge of the knitted component, the said guides being provided during the knitting operation. The guides can be knitted or laid-in lines in the fabric and/or notches formed in the fabric.

19 Claims, 5 Drawing Sheets

FABRIC

BACKGROUND OF THE INVENTION

1. Field of the Invention

This invention relates to fabrics and has particular, but not exclusive, reference to upholstered three-dimensional structures incorporating a first, knitted component and a second component, which may be a woven component.

2. Discussion of Prior Art

The manufacture of upholstered three-dimensional structures is an extremely old technique. In one such known structure a fabric cover is stretched over a core to produce both an attractive and useful structure which is frequently some form of seat.

For many years the fabric covers used in such upholstered structures have always been of a woven nature. More recently proposals have been made to produce upholstered fabrics by knitting three-dimensional shapes which can be stretched over a support to form structures such as vehicle seats. An example of such a knitted structure can be found in UK Patent Application 223,034A, the contents of which are incorporated herein by way of reference. The present invention is concerned with the interconnection between such a knitted fabric structure and a woven fabric or vinyl component, which may be required to close off the base or back of the knitted structure to form a closed sack. A particular example of such a structure would be a woven seat back panel which would be sewn onto a knitted main seat back structure.

SUMMARY OF THE INVENTION

By the present invention there is provided an upholstered three-dimensional structure including a core and a fabric cover, the fabric cover incorporating a knitted component, characterised in that there is provided a woven component sewn to the knitted component, there being provided sewing alignment guides provided in the knitted fabric during knitting at predetermined spaced locations along an edge of the knitted component sewn to the woven component, the woven component being provided with sewing alignment guides in register with the alignment guides of the knitted component.

The sewing alignment guides on the woven component may be nicks or cut-outs in the edges of the woven fabric component.

The sewing alignment guides may be additional to any pattern evident on the visible face of the knitted component.

The knitted sewing alignment guides may comprise lines of contrasting color knitted into the knitted component. The sewing guides may comprise lines of alternative stitch design or may comprise lines of stitches which form a raised portion on the surface of the fabric. The knitted sewing alignment guides may be provided in the region of the sewing area only, and are preferably not evident on the visible face of the structure after the components have been sewn together.

The knitted component may comprise a double jersey structure and may be knitted from two or more colors of yarn, and the sewing alignment guides may be formed by bringing the colored yarn to the surface of the knitted structure to form a alignment guide at predetermined locations. The knitted component may comprise a three-dimensional knitted component knitted on a flat V-bed knitting machine. The knitting machine may be under computer control and the sewing guides may be incorporated into the computer program to produce the alignment guides at the predetermined intervals. The sewing guides may be provided along straight edges spaced-apart at distances between 10 and 20 cm. The sewing guides may also be provided at locations along the edge of the knitted structure to indicate where sewing is completed and/or positions where a significant change in direction of sewing is required. The knitted structure may be knitted from polyester yarn. The knitted structure may be the fabric cover of a seat. The seat may be an automobile seat. The woven structure may be a back panel or underside panel of a seat back or seat base. The sewing alignment guides may be knitted into the fabric during knitting or laid into the fabric during knitting.

There is also provided in an upholstered three dimensional structure including a core and a fabric cover, the fabric cover incorporating two knitted components sewn together along respective edges thereof, the improvement which comprises the provision of sewing alignment guides knitted into one at least of the knitted fabric components at predetermined spaced locations along that edge of the knitted component to be sewn to the other component. The present invention further provides knitting in alignment guides to both of the knitted components to be sewn together. The sewing alignment guides may comprise lines in the fabric or may comprise nicks formed in the fabric or both lines and nicks.

The present invention yet further provides a method of manufacturing a three-dimensional structure from at least two fabric components, at least one of the fabric components being a knitted component, which includes the steps of: knitting the knitted component and incorporating sewing alignment guides in the knitted component during the knitting step, the sewing alignment guides being additional to any pattern evident on the visible face of the knitted component; providing a second component being a woven component or another knitted component, the second component having alignment guides provided in or on the second component; aligning the alignment guides on the first knitted component with respective alignment guides on the second component, and sewing the two components together.

BRIEF DESCRIPTION OF THE DRAWINGS

By way of example embodiments of the present invention will now be described with reference to the accompanying drawings, of which.

DESCRIPTION OF THE PREFERRED EMBODIMENTS

Figure 1:
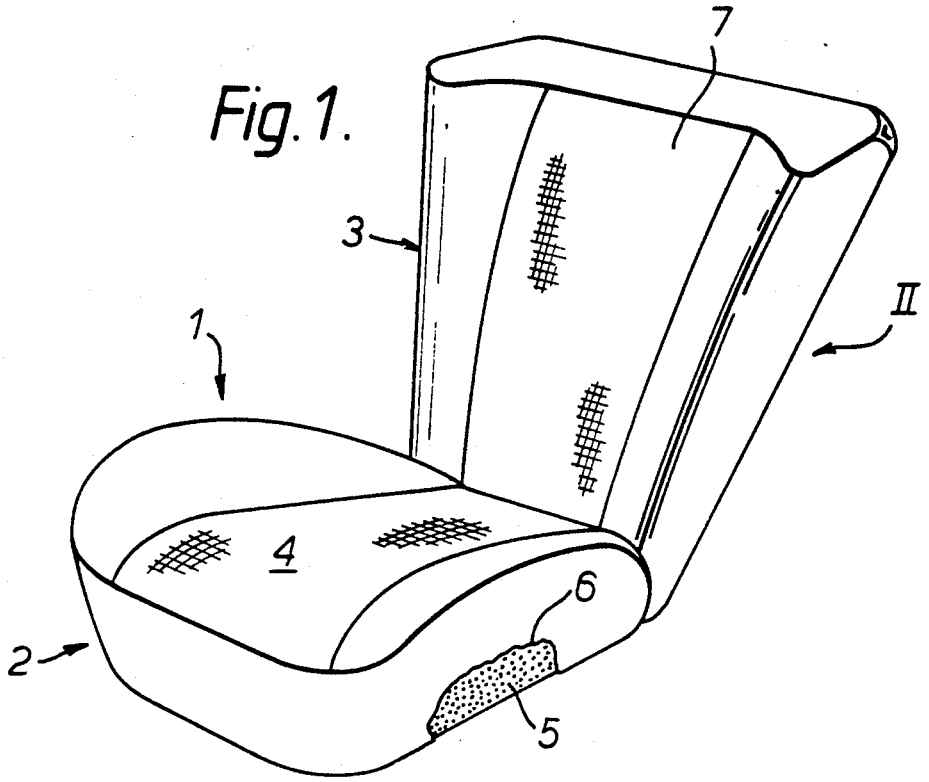
FIG. 1 is a perspective view of a seat in accordance with the invention.
Figure 2:
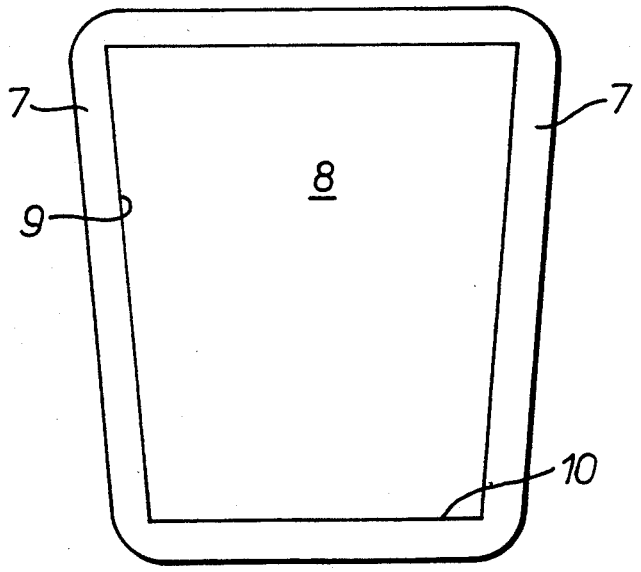
FIG. 2 is a view of FIG. 1 along the line of arrow II.

Referring to FIG. 1, this shows a seat indicated generally by 1 suitable for use in a car or other form of vehicle. The seat incorporates a squab 2 and a back 3. Essentially the seat squab comprises a cover 4 stretched over a core 5. Typically the core would comprise a foam bun of some suitable upholstery foam reinforced with a metal reinforcing structure. The core 5 is shown behind the broken away line 6 of the cover 4. Typically the base of the squab 2 would incorporate tubular loops by means of which the fabric 4 can be stretched tightly over the bun of the base 5. A typical example of a base is shown in FIG. 2 of British Patent Specification 2,223,034A referred to above.

The seat back 3 comprises a knitted face component 7 shown clearly in FIG. 1. Sewn to the back of the seat back 3 is a woven panel 8 shown in FIG. 2. The woven panel 8 is sewn to the knitted fabric face panel 7 along the line 9. As shown in FIG. 2 the line 9 extends completely around the woven panel 8; in some cases, however, the base of the panel 8 i.e. the portion 10 of line 9, would not be sewn to the knitted fabric member 7.

Figure 3:
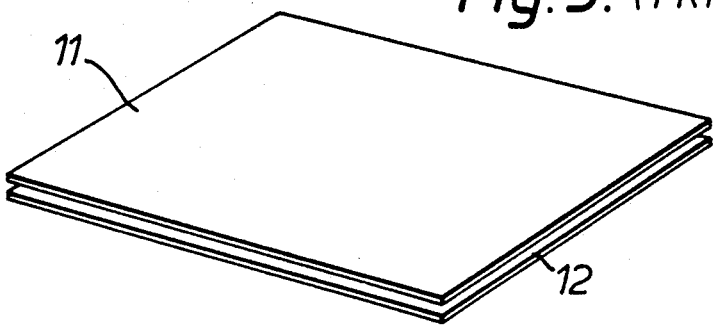
Fig. 3. (PRIOR ART)
FIG. 3 is a perspective view of a prior art fabric structure and a woven structure superimposed one on the other prior to sewing.
Figure 4:
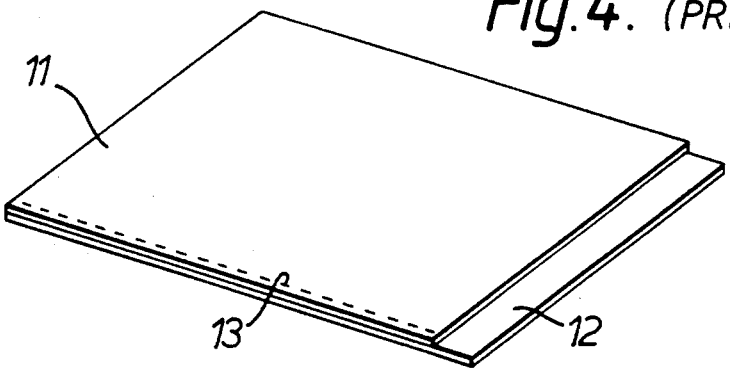
Fig. 4. (PRIOR ART)
FIG. 4 is a perspective view of the two fabric structures of FIG. 3 after sewing.

Woven fabrics tend to be less extensible than knitted fabrics and unless a great deal of care is adopted in sewing the structures of a knitted and woven fabric together, the results can be as illustrated in FIG. 4. In FIG. 3 there is shown a woven fabric panel 11 superimposed on a knitted fabric panel 12, prior to sewing the two components together on a conventional sewing machine. In a conventional sewing machine, the foot of the machine holds the two fabrics together whilst a serrated advancing mechanism operating beneath the fabric 12 advances the fabrics under the needle. The advancing mechanism tends to stretch the fabrics and simply sewing together a knitted and woven component produces the results shown in FIG. 4. The line of sewing 3 is shown clearly in FIG. 4 and it can be seen that the upper panel 11 of woven material has stretched to a smaller extent than the lower panel 12 of knitted material.

When sewing together conventional woven structures for products such as automobile seats it is known to incorporate registration marks along the edges of the components to be sewn so that the machinist can keep the edges in proper registration and if material has to be gathered to produce the desired cosmetic effect, the machinist can do this while keeping the registration marks visible. Typically registration marks are provided by producing nicks in the fabric edge or producing cut-out V-shapes. It will be clear, therefore, that the registration marks have to be produced either as a separate operation in the manufacture of the sewn structure or the cutting pattern has to incorporate the registration mark cutting knives.

Figure 5:
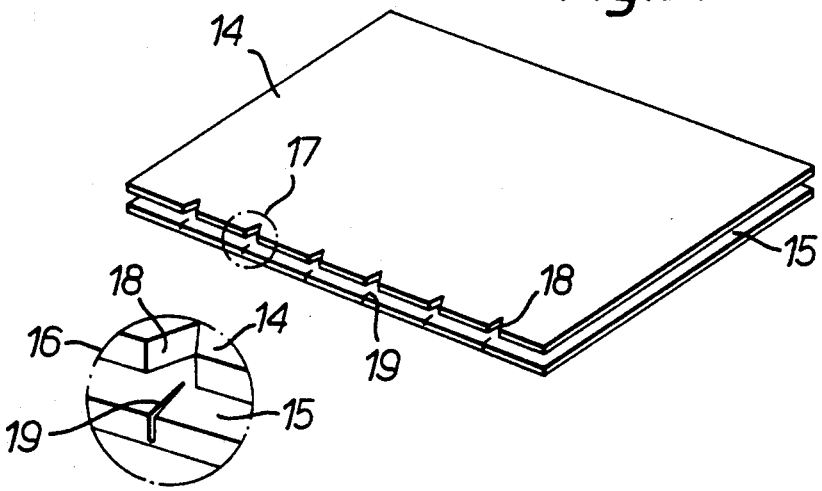
FIG. 5 is a perspective view of two structures in accordance with the present invention with a portion of FIG. 5 enlarged, FIGS. 6(1) to 6(9) are stitch diagrams of nine courses of stitches.

FIG. 5 shows a woven panel 14 prior to sewing onto a knitted panel 15 wherein the knitted panel 15 incorporates the sewing alignment guides of the present invention. The sewing alignment guides are shown more clearly in the enlarged portion in circle 16 which is an enlargement of the circle 17 of FIG. 5. The woven panel 14 incorporates notches 18 in a conventional manner. However, the knitted panel 15 has knitted into it sewing guides 19 during the manufacture of the knitted panel 15.

Typically the knitted panel 15 would be a double jersey knitted panel knitted on a flat V-bed machine. The knitted panel would incorporate one or two rows of stitches of a contrasting color knitted in to give each alignment guide 19. Because the design of the knitted panels 15 can now be carried out on a computer, it is possible to produce perfect registration of the sewing guides 19 onto the knitted component 15 without the need for any separate step in producing the sewing guides. There are, therefore, significant advances in accuracy and significant advantages in manufacturing time by incorporating the knitted-in sewing guide in accordance with the present invention.

The knitting-in of the guides can be carried out by conventional techniques. The knitting techniques useful to the invention will be found in the following works of reference.

"Knitting" by H. Wignell, Published by Pitman Publishing 1971 Edition, London

"An Introduction to Weft Knitting" by J. A. Smirfitt, Published by Merrow Technical Library, Watford, England, 1975

"Advanced Knitting Principles" Edited by C. Reichman, Published by National Knitted Outerwear Association, New York, N.Y., 964

"Fully Fashioned Garment Manufacture" by R. W. Mills,Published by Cassell, London, 1965

"Knitting Technology" by D. J. Spencer, Published by Pergamon Press, London, 1983.

The knitting may be carried out on a flat bed machine such as a Stoll CMS Selectanit machine, for details see Knitting International, May 1990, pages 26–28, or a Steiger Electra 120FF machine, for details see Knitting International, April 1990, page 96, or A Shima Seiki SES machine, for details see Knitting International, September 1989, page 60.

Figure 6:
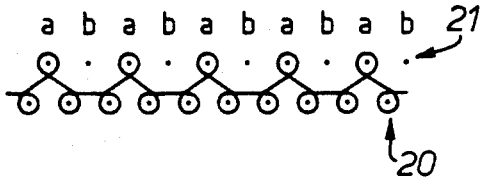
Figure 6:
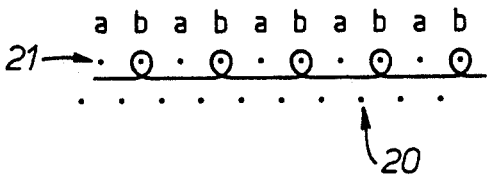
Figure 6:
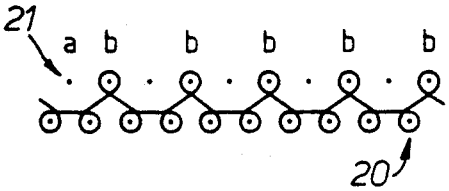
Figure 6:
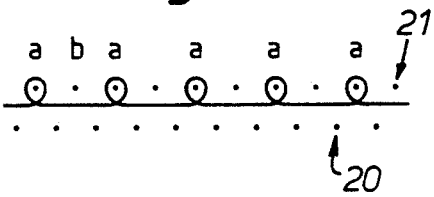
Figure 6:
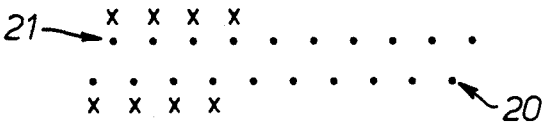
Figure 6:
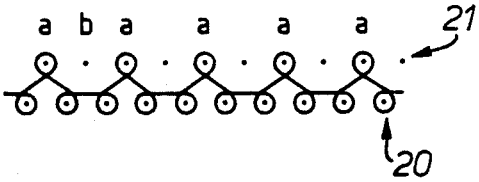
Figure 6:
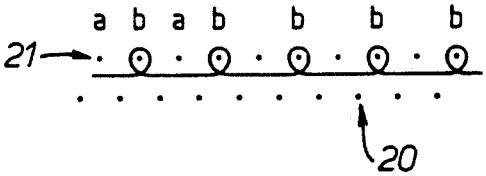
Figure 6:
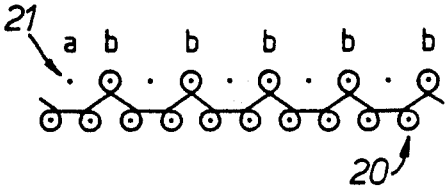
Figure 6:
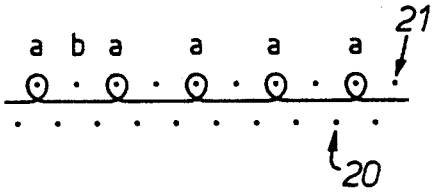
Figure 7:
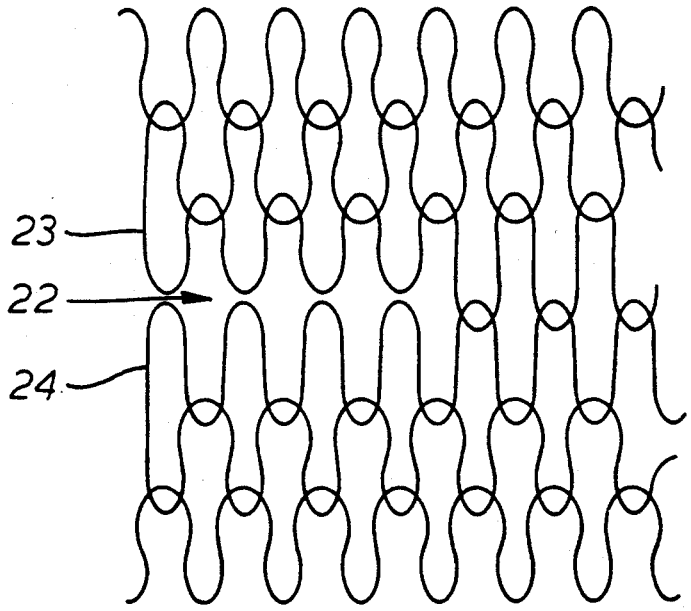
FIG. 7 is a schematic diagram of a knitted-in notch, and FIGS. 8(1) to 8(8) are stitch diagrams of eight courses of stitches.

The details of how alignment guides may be knitted-in can be seen clearly in the stitch diagrams shown in FIGS. 6(1) to 6(9) and in FIG. 7.

The nine diagrams shown in FIG. 6 comprise nine courses used to knit-in a V notch which would look similar to the notch cut into the woven fabric and illustrated at 18 in FIG. 5.

FIGS. 6(1) to 6(4) represent a four course repeat of a plain faced bird's-eye backed structure. FIG. 6(5) represents the releasing or pressing off of the four sets of loops held on the left-hand selvedge needles which produce the V notch. FIGS. 6(6) to 6(9) represent a further four course repeat which is identical to that of the courses shown in FIG. 6(1) to FIG. 6(4) so that in total there is produced a structure in which there is a V notch on the edge of the fabric.

In FIG. 6(1) the first course shows all of the needles in a lower bed 20 being knitted on by the traverse of a conventional yarn carrier whilst every alternate needle in an upper bed 21 is knitted on. For convenience, the needles in the upper bed are labelled a, b, a, b etc. It can be seen that in FIG. 6(1) only the needles a on the upper bed 21 are knitted on in the first course, and the needles b are not knitted on. In the second course, only the needles b are knitted on in the upper bed 21 and none of the needles in the lower bed 20 are knitted on at all. In the third course, all the needles in the lower bed 20 are again knitted on whereas in the upper bed 21 only the needles labelled b are knitted on.

In the fourth course, no needles in the lower bed 20 are knitted on whereas in the upper bed only the a needles are knitted on.

The four course repeat for the plain faced bird's-eye back structure may be used as many times as is required. To form the notch 18, the stitches on the left-hand four needles are pressed off during the next traverse of the CAMBOX as is shown by the four pairs of x in the stitch diagram of FIG. 6(5), the needles for the remaining stitches are not raised and are not knitted on during that traverse of the CAMBOX. The next four courses illustrated in stitch diagrams 6(6), 6(7), 6(8) and 6(9) are identical to the respective courses illustrated in FIGS. 6(1) to 6(4). This total sequence then gives an edge with a notch similar to the notched edge of the sheet 14 of FIG. 5. The stitches in the knitted fabric are shown schematically in FIG. 7, where it can be seen that a notch 22 is formed between stitches in a course 23 and stitches in a course 24. Stretching the fabric shown in FIG. 7 will tend to widen the notch 22.

Figure 8:
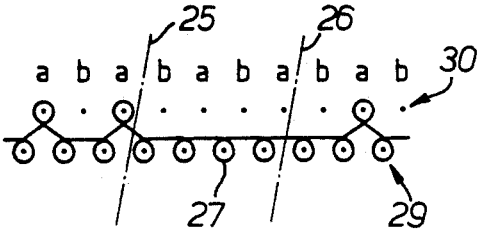
Figure 8:
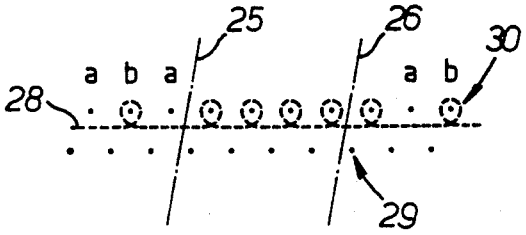
Figure 8:
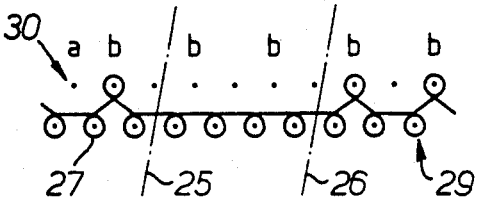
Figure 8:
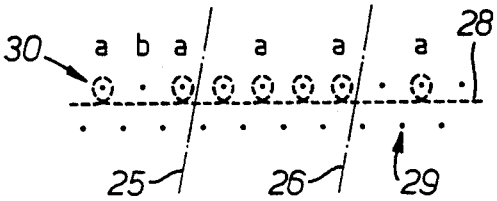
Figure 8:
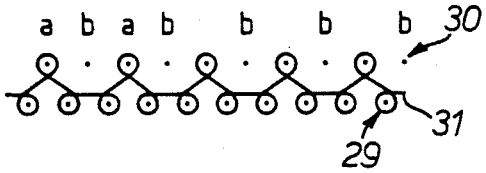
Figure 8:
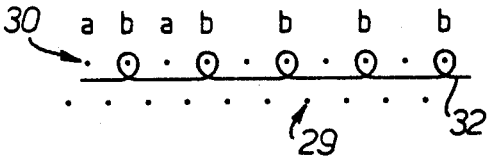
Figure 8:
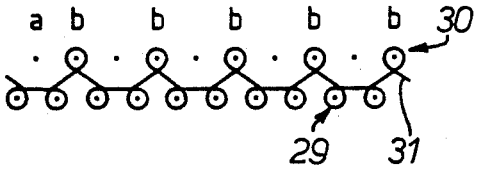
Figure 8:
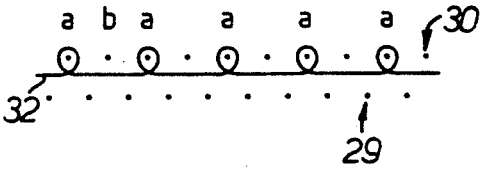

To knit-in a colored line on the reverse side only of a knitted fabric, the knitting can be carried out in accordance with the stitch diagrams illustrated in FIGS. 8(1) to 8(8). In FIGS. 8(1) to 8(4) there is represented a plain faced bird's-eye backed structure produced with two colors of yarn, a lighter yarn 27 shown with a solid line and a darker yarn 28 shown with a dashed line. In the center of each Figure, between oblique lines 25 and 26, the birds-eye backing sequence is replaced by a concentration of loops of a single color as can be seen in FIGS. 8(2) and 8(4) where the yarn 28 being knitted on needles of an upper bed 30 is a different color to the yarn 27 knitted on the needles of the upper bed 30 and on needles of a lower bed 29 as shown in FIGS. 8(1) and 8(3).

In FIG. 8(1), which shows the first course in a sequence, the yarn 27 is knitted on all of the needles in the lower bed 29, but only on the alternate needles labelled a in the upper bed 30, and then only outside the region defined between the oblique lines 25 and 26. Within the region defined between the lines 25,26, the yarn 29 is not knitted on the needles of the upper bed 30. In the next course, shown in FIG. 8(2), the darker yarn 28 is knitted only on the upper bed. Outside the region defined between the oblique lines 25 and 26 knitting is effected only on the alternate needles 6. Within the said region the yarn 28 is knitted on all of the needles in the upper bed 30.

In the next course, shown in FIG. 8(3) the lighter yarn 27 is again knitted on all of the needles in the lower bed 29, but on only the alternate needles b in the upper bed 30 that lie outside the region between the oblique lines 25,26. In the fourth course of the sequence shown in FIG. 8(4) the darker yarn 28 is knitted on only the needles in the upper bed 30, and then only on the needles labelled a outside the region between the oblique lines 25,26. Within the said region 25,26 the yarn 28 is knitted on all the needles of the upper bed.

This knitting sequence is followed by a conventional bird's-eye backed knitting sequence repeated every four courses and shown in FIGS. 8(5) to 8(8). The structure is knitted with two yarns 31,32, which can be the same color or different colors. The yarn 32 can, if required, be the same color as yarn 28, and the yarn 31 can, if required, be the same color as yarn 27. It will be seen that the stitch structure shown in FIGS. 8(5) to 8(8) is the same as the bird's-eye backed structure shown in FIGS. 6(1) to 6(4).

Thus, by using a different colored yarn in the center of the knitting sequence illustrated in FIGS. 8(1) to 8(4), there is produced on the reverse of the fabric a mark which corresponds to line 19 illustrated in FIG. 5 on sheet 15.

As is mentioned above, typically the knitted panel would be a double jersey structure and would typically be a polyester double jersey structure knitted from two colors of yarn with the less dominant on the back of the fabric being brought through onto the face to produce the knitted line 19. Alternatively thicker yarns may be knitted-in to produce the line 19 or a separate color may be knitted-in or the stitches may be altered in such a way as to produce a visual mark 19.

If two knitted components are to be joined together there is a further advantage in knitting-in the registration points so that, for example, knitted V-shapes can be incorporated into the panel 14 and the edges can be knitted with the registration points already in position. It will be understood that the sewing alignment guides on the knitted component 15 although shown as a line could, in fact, be a knitted V. Furthermore, it will be appreciated that either registration marks—such as dashed lines along the edge could be knitted-in if required. It will also be appreciated that the sewing alignment guides may be laid into the fabric during knitting rather than knitted in. A thread is laid in when it is incorporated into the knitted structure without being formed into interengaging loops by the needles of the knitting machine.

The sewing alignment guides are preferably only provided where required i.e. in those regions where components are to be sewn, are provided only on the parts of the fabric not visible when the structure is in use, and are additional to any pattern provided on the fabric for aesthetic reasons. The visible face of the fabric is that side of the fabric seen by the viewer when the structure is in use e.g. the outside of the seat.

What is claimed is:

1. An upholstered three-dimensional structure including a core and a fabric cover, the fabric cover incorporating a knitted component, whereby there is provided a woven component sewn to the knitted component, there being provided sewing alignment guides provided in the knitted fabric during knitting at predetermined spaced locations along an edge of the knitted component sewn to the woven component, the woven component being provided with sewing alignment guides, in register with the alignment guides of the knitted component.

2. A structure as claimed in claim i in which the sewing alignment guides on the woven component are nicks or cut-outs on the edges of the woven fabric.

3. A structure as claimed in claim 1, in which the knitted sewing alignment guides comprise lines of contrasting colour knitted into the knitted component.

4. A structure as claimed in claim 1, in which the sewing guides comprise lines of alternative stitch design or comprise lines of stitches which form a raised portion on the surface of the fabric.

5. A structure as claimed in claim 1, in which the sewing guides are additional to any pattern evident on the visible face of the knitted component.

6. A structure as claimed in claim 1, in which the knitted component comprises a double jersey structure and is knitted from two or more colours of yarn, and each sewing alignment guide is formed by bringing one coloured yarn to the surface of the knitted structure to form an alignment guide at each predetermined location.

7. A structure as claimed in claim 1, in which the knitted component is a three-dimensional knitted component knitted on a flat V-bed knitting machine.

8. A structure as claimed in claim 7, in which the knitting machine is under computer control and the sewing guides are incorporated into the computer program to produce the alignment positions at the predetermined intervals.

9. A structure as claimed in claim 1, in which the sewing guides are provided along straight edges spaced-apart at distances between 10 and 20 cm.

10. A structure as claimed in claim 1, in which the sewing guides are also provided at locations along the edge of the knitted structure to indicate where sewing is completed.

11. A structure as claimed in claim 1, in which the knitted structure is knitted from polyester yarn.

12. A structure as claimed in claim 1, in which the knitted structure is the fabric cover of a seat.

13. A structure as claimed in claim 12, in which the seat is an automobile seat.

14. A structure as claimed in claim 13, in which the woven structure is one of a back panel and an underside panel of one of a seat back and a seat base.

15. A structure as claimed in claim 1, in which the sewing alignment guides are located in the fabric during knitting.

16. In an upholstered three-dimensional structure including a core and a fabric cover, the fabric cover incorporating two knitted components sewn together along respective edges thereof, the improvement which comprises the provision of sewing alignment guides knitted into one at least of the knitted fabric components at predetermined spaced locations along that edge of the knitted component to be sewn to the other component.

17. A structure as claimed in claim 16, in which alignment guides are knitted into both of the two knitted components to be sewn together.

18. A structure as claimed in claim 16, in which the sewing alignment guides are at least one of lines in the fabric and nicks provided in the fabric.

19. A structure as claimed in claim 1 in which the sewing guides are also provided at locations along the edge of the knitted structure to indicate where a significant change in direction of sewing is required.

* * * * *

UNITED STATES PATENT AND TRADEMARK OFFICE

CERTIFICATE OF CORRECTION

PATENT NO. : 5,232,761

DATED : August 3, 1993

INVENTOR(S) : Day et al.

It is certified that error appears in the above—identified patent and that said Letters Patent is hereby corrected as shown below:

| | |
|---|---|
| Col. 1, line 24 | cancel "223,034A" and substitute --2,223,034A--. |
| Col. 1, line 66 | cancel "a" and substitute --an--. |
| Col. 3, line 4 | cancel "3" and substitute --13--. |
| Col. 4, line 25 | cancel "964" and substitute --1964--. |
| Col. 6, line 51 | (Claim 2) cancel "claim i" and substitute --claim 1--. |

Signed and Sealed this

Fifteenth Day of March, 1994

*Attest:*

*Attesting Officer*

Bruce Lehman

BRUCE LEHMAN

*Commissioner of Patents and Trademarks*